US005120060A

United States Patent [19]

Parker et al.

[11] Patent Number: 5,120,060

[45] Date of Patent: Jun. 9, 1992

[54] CASINO GAME METHOD AND APPARATUS

[75] Inventors: J. J. Parker; Sandy Tiedeman; William J. Baugh; Stephen Stewart, all of Las Vegas, Nev.

[73] Assignee: James and Rosemarie Parker Family Trust, Las Vegas, Nev.

[21] Appl. No.: 755,524

[22] Filed: Sep. 5, 1991

[51] Int. Cl.[5] ..... A63F 7/40; A63F 7/30

[52] U.S. Cl. ..... 273/138 A; 273/121 B; 273/120 A

[58] Field of Search ..... 273/138 A, 138 R, 121 B, 273/121 A, 120 R, 120 A, 123 R, 123 A

[56] References Cited

U.S. PATENT DOCUMENTS

| | | | |
|---|---|---|---|
| 426,546 | 4/1890 | Reed | 273/123 R |
| 524,475 | 8/1894 | Wheeland | 273/138 R |
| 1,181,027 | 4/1916 | Mannhardt | 273/123 R |
| 1,275,613 | 8/1918 | Sedlak | 273/120 R |
| 1,947,772 | 2/1934 | Harris | 273/138 R |
| 2,732,210 | 1/1956 | Heide | 273/86 |
| 3,531,114 | 9/1970 | Parks et al. | 273/138 R |
| 3,797,828 | 3/1974 | Ishikawa et al. | 273/126 |
| 3,825,265 | 7/1974 | Pitkanen et al. | 273/126 |
| 3,897,951 | 8/1975 | Morrison et al. | 273/121 A |
| 4,055,344 | 10/1977 | Soucie | 273/110 |
| 4,496,160 | 1/1985 | Wichinsky et al. | 273/369 |
| 4,508,336 | 4/1985 | Yokoi | 273/121 B |
| 4,662,636 | 5/1987 | Crompton | 273/138 A |
| 4,759,551 | 7/1988 | Crompton | 273/355 |
| 4,844,464 | 7/1989 | Berge | 273/138 R |
| 4,893,821 | 1/1990 | deOrbegoso et al. | 273/371 |
| 5,016,879 | 5/1991 | Parker et al. | 273/126 |

*Primary Examiner*—Benjamin Layno

*Attorney, Agent, or Firm*—Quirk, Tratos & Roethel

[57] ABSTRACT

A coin is inserted into a coin slot and another coin is dropped from the top center of a playing field into a pachinko-type maze. The pachinko-type maze includes animated diverter pins and a series of capture gates. Each capture gate has associated therewith a pair of upper scoring lights and a pair of lower scoring lights that blink on and off. When the coin passes through a particular capture gate, if both pairs of scoring lights associated with that capture gate are illuminated, an indicator select light associated with the capture gate is illuminated and the player wins. Beneath the capture gates are a plurality of bin doors mounted to be pivotally openable by a bin door cam mechanism. If an indicator select light is illuminated, the player selects one of the bin doors to be opened and any coins lying on the bin door fall through the opening and into the payout hopper. If the falling coin does not result in a winning play, then the coin simply comes to rest in the coin collection area on top of the unopened bin doors and the player does not win. As coins pile up on the bin doors, coins will slide forward into an overflow chute. The coins in the overflow chute are also allowed to fall into the payout hopper and paid to the player and the house.

36 Claims, 4 Drawing Sheets

CASINO GAME METHOD AND APPARATUS

BACKGROUND OF THE INVENTION

1. Field of the Invention

This invention relates to a casino game, and more particularly to a casino game method and apparatus that utilizes falling coins to determine the outcome of the game and payouts to the player are made from coins displayed in the playing field of the game.

2. Description of the Prior Art

The game of the present invention has its origins in the well-known game that normally goes by the name of pachinko. Pachinko involves a vertical playing field that has a glass cover plate and a solid back wall. A plurality of deflection pins or pegs extend at right angles from the back wall to the glass cover plate. A disk, coin, token, ball or other scoring device is dropped through a slot at the top of the playing surface and bounces back and forth between the deflection pins as it falls toward the bottom of the playing surface. Along the bottom of the playing surface are a plurality of scoring slots or capture gates. The player scores points corresponding to the value assigned to the particular scoring slot or capture gate in which the falling disk ultimately comes to rest.

A typical version of pachinko is shown in U.S. Pat. No. 524,475 (Wheeland), which patent was granted in 1894. This patent in fact is directed at an improvement to the game of pachinko in which the deflection pins or pegs are made of a spring material to give the falling disk an even more random travel path. Another example of a pachinko game is shown in U.S. Pat. No. 1,947,772 (Harris).

Pachinko has proven difficult to adapt to a casino gaming environment. Gaming regulators require any gaming device to result in a random determination of winning and losing events. In a pachinko game, the final destination of the falling disk is determined by the location of the deflection pins. Even if the deflection pins are positioned in such a manner to make the disk fall as randomly as possible, the falling disk will still more often fall toward the middle of the scoring area than toward the outer ends.

There are also casino games that use each coin put in by the player as the object that creates the random event that determines whether the player receives a payout for his wager. Representative of these types of games is the game disclosed in U.S. Pat. No. 4,496,160 to Wichinsky et al.

The Wichinsky patent is a flipper-type game in which a coin, such as a quarter, is inserted by the player into the machine and projected into the playing field. If the coin falls through one of a plurality of baskets, then the player earns a payout. The coin subsequently comes to rest on one of an upper shelf or a lower shelf. Each shelf has associated therewith a series of pusher bars that push the coins toward the edge of the shelf. During the play of the game, one or more coins will eventually fall over the end of the lower shelf and the player will win those coins.

One drawback to the Wichinsky game is that the house's portion of the game is collected by coins falling over the lower shelf at the outer edges of the lower shelf. The house will not know exactly what it is going to win from day to day because it all depends on how many coins happen to fall over the outer edges of the lower shelf. The player can also become disappointed because, after watching the pusher bars push one or more coins over the edge of the lower shelf, the player will only receive those coins that fall over the center area of the lower shelf.

Another casino game that utilizes a pachinko-type format is disclosed in U.S. Pat. No. 5,016,879 (Parker et al.). Falling disks passing through scoring slots or capture gates determine the winning combination. If the falling disks form a winning combination, the player wins a predetermined multiple of his wager.

OBJECTS, FEATURES AND ADVANTAGES OF THE INVENTION

It is an object of the present invention to provide a casino game method and apparatus that uses a coin put in by the player as the object that creates the random event that determines whether the player receives a payout for his wager and the player can physically observe the movement of the coin through the playing field of the game.

It is a further object of the present invention to provide a casino game method and apparatus in which coins that are visible to the player are available for payment to the player depending on the combination of random events that may occur.

It is a further object of the invention to allows the player to select which of a plurality of bin doors are to be opened to allow coins thereon to fall through in the event a player achieves a winning play.

It is a further object of the present invention to provide a casino game method and apparatus in which the profit of the game is determined by the taking for the house a predetermined percentage of the coins that are paid out at the time that the payout of coins is made to the player.

It is a feature of the present invention that the coins fed into the game come to rest on a coin collecting area on the bottom of the playing field. The coin collecting area is comprised of a plurality of pivoting bin doors, one of which can be opened by the player depending on whether the coin passes through an activated capture gate as it falls through the playing field. When one of the bin doors is opened, the coins on top of the bin door fall into a drop chute and then into a payout hopper which pays the coins to the player and to the house.

It is a further feature of the present invention that the house collects its percentage of the game by receiving a predetermined percentage of the coins that fall into the payout hopper.

It is an advantage of the present invention that the house knows exactly what percentage it will collect of the coins that are paid out.

It is a further advantage of the present invention that the operation of the game is visible to the player at all 10 times through the glass enclosed playing field.

It is a further advantage of the present invention that the player can select which bin door will be opened in the event that the player achieves a winning play.

SUMMARY OF THE INVENTION

A coin is inserted into a waist high coin slot in a gaming machine. At approximately the same time, another coin is dropped from the top center of a generally vertically oriented playing field into a pachinko-type maze. The playing field is a slightly off-vertical pachinko-type maze including animated diverter pins and a series of capture gates. At the approximate center of the playing field, the capture gates are arranged side by side. Each capture gate has associated therewith a pair of upper scoring lights and a pair of lower scoring lights that blink on and off. When the coin passes through a particular capture gate, if both pairs of scoring lights associated with that capture gate are illuminated, an indicator select light associated with the capture gate is illuminated and the player wins.

Beneath the capture gates are a plurality of bin doors mounted generally horizontally and arranged to be pivotally openable by a motor that operates a bin door cam mechanism. If an indicator select light is illuminated when a coin passes through the capture gate indicating a winning play, the player selects one of the bin doors to be opened and any coins lying on the bin door fall through the opening and into the payout hopper. If the falling coin does not result in a winning play, then the coin simply comes to rest in the coin collection area on top of the unopened bin doors and the player does not win.

As coins pile up on the bin doors, coins will slide forward into an overflow chute. On a periodic basis, the coins in the overflow chute are also allowed to fall into the payout hopper. In this event the player and the house collect the coins that have come to rest in an overflow chute adjacent the coin collecting area.

DETAILED DESCRIPTION OF THE PREFERRED EMBODIMENTS

Figure 1:
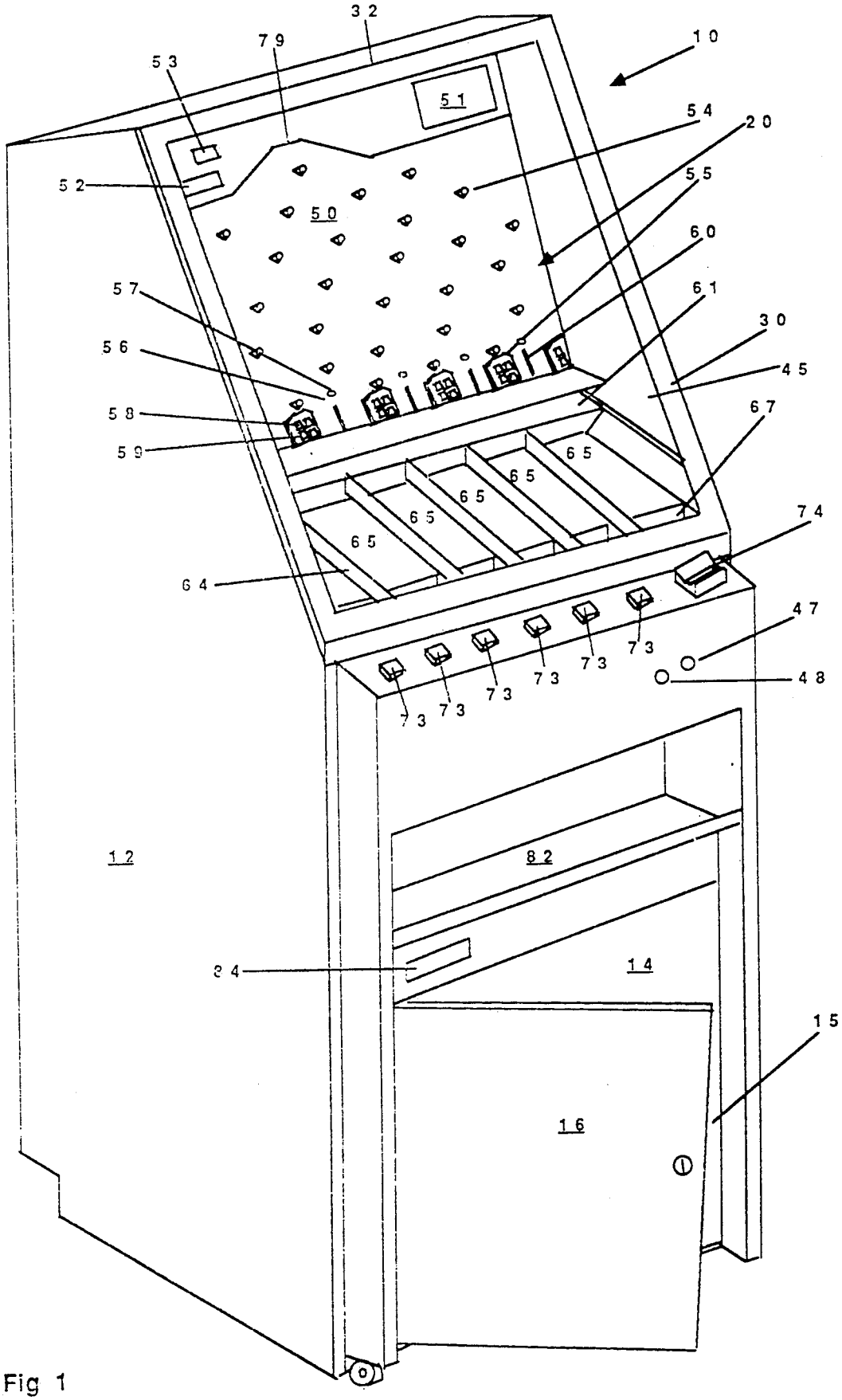
FIG. 1 is a perspective view of the gaming apparatus of the present invention.

The gaming machine apparatus used to play the game of the present invention is shown generally at 10 in FIG. 1. The apparatus comprises a generally upright cabinet 12, the approximate upper half of which houses the game area 20 which includes the playing field 50 and a display area providing playing information to the player. Below the upper game area 20, there is provided a coin payout tray 82 into which the coins or tokens are dispensed whenever the player wins.

Below the coin tray 82, a lockable door 16 conceals the drop area 14 in the apparatus where coins or tokens that have been wagered and are intended for the house are stored for removal at a later time. As is conventional, a coin drop bucket (not shown) is placed in the drop area 14 and is used to collect the coins that belong to the house. The internal area of the machine also houses the electronic apparatus necessary to operate the game as well as other mechanical apparatus, such as the coin acceptor 75 and the coin meters 84, conventionally found in gaming devices. At an appropriate location on the apparatus, an insert coin head 74 is provided to receive the coins or tokens that players insert to activate the game.

Figure 3:
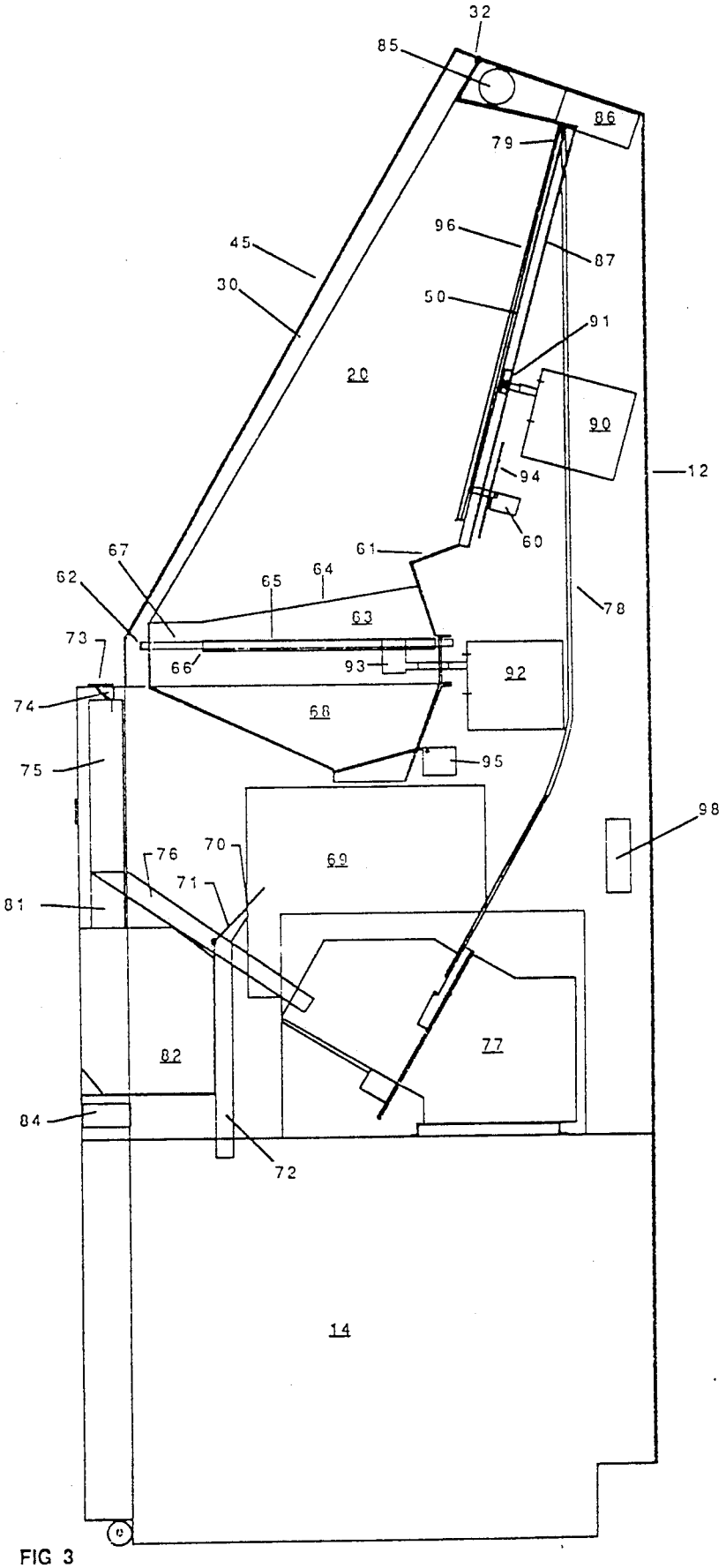
FIG. 3 is a side interior view of the gaming apparatus of the present invention.

As shown in FIGS. 1 and 3, the upper game area 20 is behind a top door 30 which is pivotally mounted to the cabinet 12 by means of a hinge 32 or other suitable device. The door 30 includes a window 45 made of glass or other suitable transparent material so that the game area 20 is visible to a player standing at the gaming apparatus.

The game area of the apparatus of the present invention is shown generally at 20 in the drawings. The top section of the game area 20 includes a readout light 52 in which written information can be displayed to the player. Also provided in the top portion of the game area 20 is a "player choose" light 51 and a tilt light 53.

As part of the game area 20, there is provided a coin entry 79 that receives a coin 80 from the coin lift track 78. The coin entry 79 is located at the approximate center of the top end of the playing field 50.

The playing field 50 includes a generally slightly off-vertical back plate 87 in which are mounted a series of animated deflection pins 5 which direct the movement of the coin 80 as it falls through the playing field 50. In the preferred embodiment of the invention, each deflection pin 54 reciprocates horizontally in a plane perpendicular to the playing field 50 so that as each coin 80 hits a deflection pin 54, the coin 80 is bounced to give added movement to the coin 80. This reciprocal movement of the deflection pins 54 is effected by causing the back plate 87 to reciprocate by means of the deflection pin motor 90 and deflection pin cam mechanism 91 attached to the back plate 87.

Figure 2:
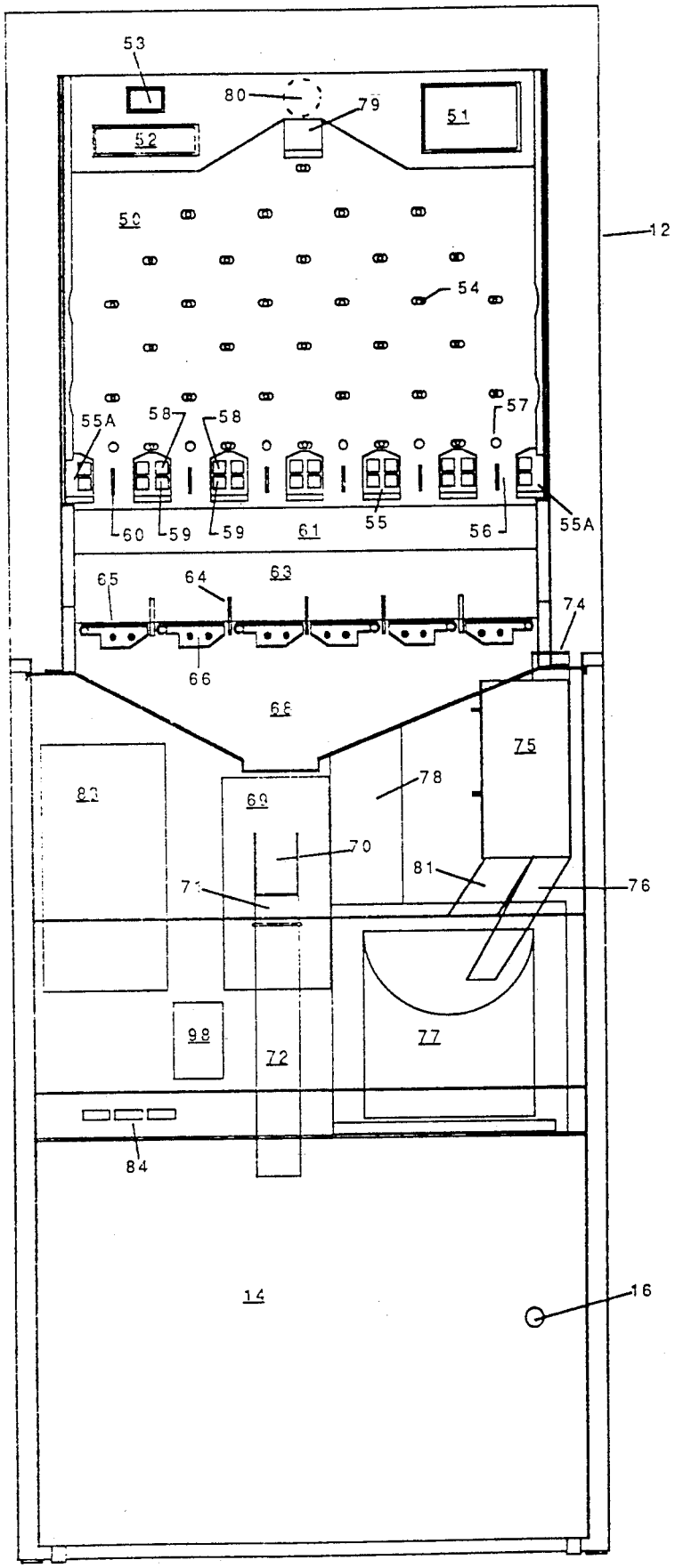
FIG. 2 is a front view of the gaming apparatus of the present invention.

As shown in FIGS. 2, the preferred embodiment of the invention uses thirty-two deflection pins 54 but more or less deflection pins 54 can be used and can be spaced about the back plate 87 in any desired pattern.

The playing field 50 is also preferably provided with a spaced apart playfield glass 96 to ensure that the coins are directed into one of the capture gates 56.

At approximately the bottom of the playing field 50 are mounted a series of enclosures 55, each of which has a deflection pin 54 immediately adjacent the upper end of the enclosure 55. The deflection pin 54 protects the enclosure 55 from wear and tear that would be encountered from the falling coins 80. The enclosures 55 demarcate and separate the capture gates 56 from each other and the enclosures are shaped to guide a falling coin 80 into one of the capture gates 56.

Figure 4:
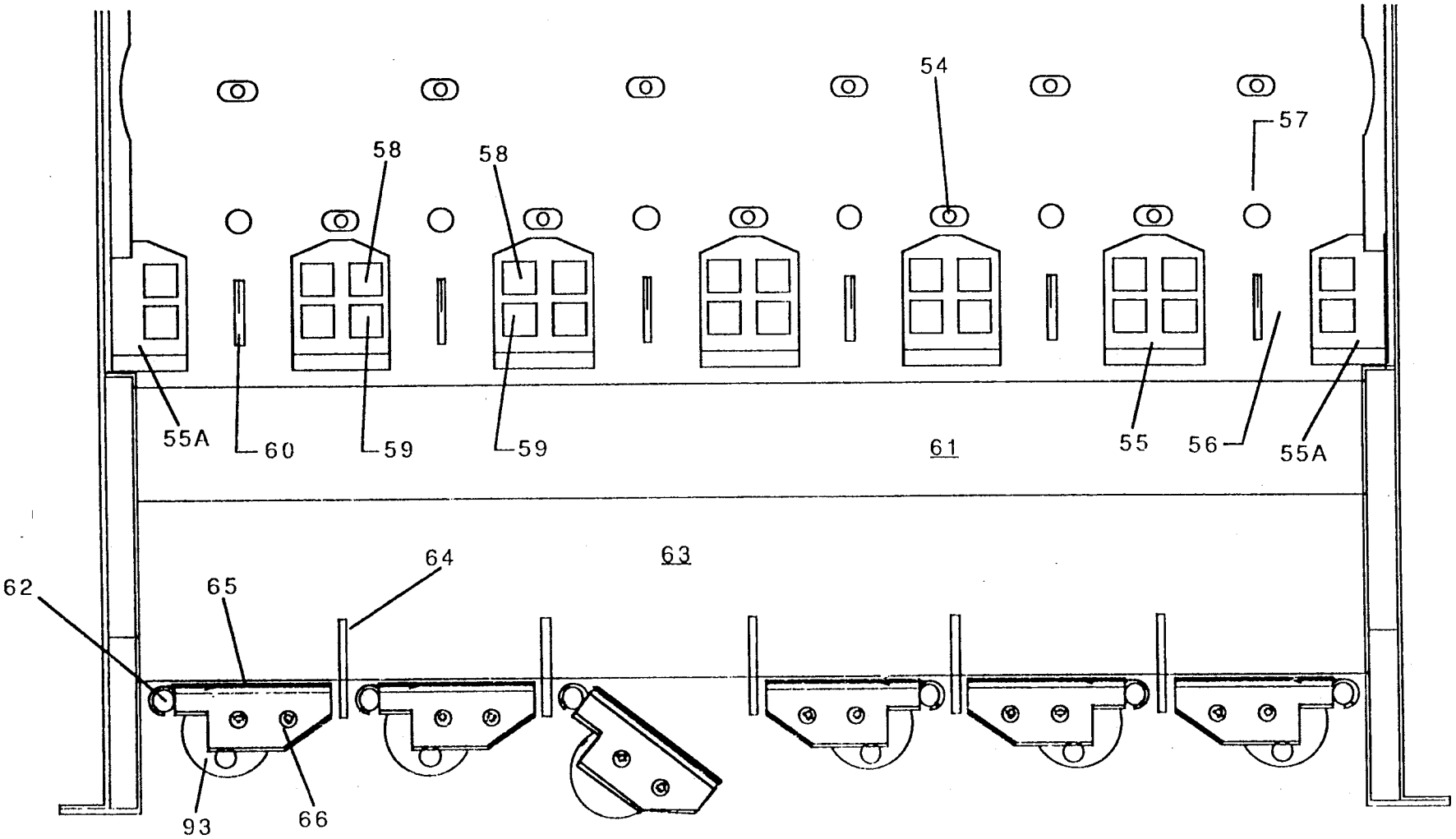
FIG. 4 is a front detailed view of a portion of the bin doors, cam mechanisms and capture gates of the gaming apparatus of the present invention.

Each enclosure 55 includes a pair of upper scoring lights 58 and a pair of lower scoring lights 59. In the preferred embodiment of the present invention as shown in FIGS. 2 and 4, there are six capture gates 56 which necessitates five full enclosures 55 and two half enclosures 55A at each side end of the playing field 50.

In between each adjacent enclosure 55 is a capture gate 56 and each capture gate 56 has associated therewith an indicator select light 57. A mechanical trip lever 60 is provided in each capture gate 56 so that as the coin 80 passes into a particular capture gate 56, the mechanical trip lever 60 will be forced downwardly which will electronically send a signal to the electronic control box 83 indicating which capture gate 56 the coin 80 has passed through. In the preferred embodiment, the movement downwardly of trip lever 60 allows an optical beam to pass to a sensor to provide the electronic signal, but other appropriate means can be used to effect the electronic signal.

Below the series of enclosures 55, there is provided a slanted ledge that acts as a coin deflector 61 and a coin collecting area 63. The coin collecting area 63 is generally horizontal although preferably angled slightly toward the front of the gaming apparatus 10. The coin collecting area 63 is divided into a plurality of individual compartments separated by vertical bin dividers 64. In the preferred embodiment, there are five vertical bin dividers 64 resulting in six individual compartments. The space between each bin divider 64 comprises a pivotable bin door 65. Each bin door 65 is mounted for pivoting movement on a shaft 62. The pivoting of the bin door 65 is effected by the movement of the bin door cam mechanism 93 actuated by the bin door motor 92.

In the preferred embodiment of the present invention, there are six bin doors 65, each mounted on its own shaft 62 and actuated by its own bin door cam mechanism 93 and the associated bin door motor 92. As will be explained in detail below, any one of the six bin doors may be pivoted to an open position independently of the other bin doors.

An overflow area 67 is provided toward the forward end of the coin collecting area 63 and the overflow area 67 communicates with the win dump chute 68.

The area underneath the bin doors 65 also communicates with the win dump chute 68. Any coins that fall into the win dump chute 68 are directed into a payout hopper 69. The payout hopper 69 can be any conventional hopper that is configured to dispense all of the coins that are collected in the hopper. A typical payout hopper could be Model No. NH-1, Model No. WH-1 or Model No. WH-2, all made by the Asahi Seiko Company.

On the front portion of the cabinet, an insert coin head 74 is provided for receiving coins wagered by the player. The coin head 74 communicates with a coin acceptor 75 that determines that the coin wager is legitimate. The coin acceptor can be any conventional coin acceptor such as Model No. CC-40-A, made by Coin Mechanisms, Inc., Chicago, Ill. Any counterfeit coins are returned to the player by way of the coin reject chute 81.

Legitimate coins are conveyed through coin-in chute 76 into a coin-in hopper 77. A coin lift track mechanism 78 is provided to move coins placed into the gaming apparatus 10 by a player from the coin-in hopper 77 to the coin entry 79 at the top of the playing field 50. Any suitable coin lift track mechanism 78 may be used. In the preferred embodiment, an elevator arm is attached to the coin-in hopper 77 and coins 80 are fed up the elevator arm to the coin entry 79. A typical hopper and elevator arm arrangement is shown in U.S. Pat. No. 4,518,001 (Branham), which is incorporated herein by reference.

Various other appurtenant devices typically used in a gaming device are also provided. The top of the cabinet 12 is provided with an interior game illumination light 85 to provide the appropriate lighting to the playing field 50. Adjacent to the illumination light 85, an exhaust fan 86 can be mounted to cool the electronic equipment used in side the cabinet 12. Coin counting meters 84 are also provided in the lower portion of the cabinet to perform the necessary accounting functions relating to coins in and coins out.

The further operation of the apparatus will be described in connection with explaining the method of playing the game.

A player inserts a coin 80 into the coin head 74 to begin the game. The coin is fed from the coin head 74 into the coin acceptor 75. If the coin is accepted as valid by the coin acceptor 75, the coin continues into the coin-in hopper 77 where it is conveyed by the coin lift track 78 to the coin entry 79 at the top of the playing field 50.

In the preferred embodiment, there is provided a plurality of coins 80 aligned along the length of the coin lift track 78 and in the coin-in hopper 77 so that the introduction of one coin into the coin head 74 results in another coin immediately being delivered to the coin entry 79 so as not to delay the playing of the game.

The coin 80 rolls or slides into the playing field 50 through the coin entry 79. As the coin 80 falls by gravity through the playing field 50, it hits one or more of the deflection pins 54 to effect a random movement to the coin through the playing field 50.

While the coin 80 is falling through the playing field 50, each pair of upper scoring lights 58 and each pair of lower scoring lights 59 associated with each capture gate 56 are continually blinking on and off. The associated pair of upper scoring lights 58 on each side of each capture gate 56 are joined together to blink on and off simultaneously. Likewise, the associated pair of lower scoring lights 59 on each side of each capture gate 56 are joined together to blink on and off simultaneously.

In the preferred embodiment of the invention, each pair of upper scoring lights are timed independently of each pair of lower scoring lights, but with the same frequency. At any point in time, one pair of upper scoring lights 58 and one pair of lower scoring lights 59 are illuminated. Alternatively, the frequency of the blinking of the upper and lower scoring lights could be adjusted so that more than one pair of upper, lower or both scoring lights are illuminated at the same time. It is also possible that more than one capture gate could be active at any point in time. Because coins are dispensed to the player and the house either from coins that fall through an opened bin door or that fall into the overflow area, the percentage hold of the game is not affected by how often bin doors can be opened. The percentage hold of the game is strictly related to the manner in which the coins in the payout hopper are apportioned.

Occasionally the pair of upper scoring lights 58 and the pair of lower scoring lights 59 will be illuminated at the same time at the same capture gate 56. Whenever the simultaneous illumination of the upper scoring lights 58 and the lower scoring lights 59 does occur at the same capture gate 56, the indicator select light 57 associated with that capture gate 56 will also illuminate to alert the player that an active capture gate exists.

When the scoring lights are programmed to have a single pair of upper scoring lights and a single pair of lower scoring lights illuminated at any one time, the odds are one in thirty-six that a coin 80 passing through a particular capture gate 56 will do so when the indicator light 57 is illuminated. If the coin 80 does pass through a such an active capture gate 56, then the player is a winner and the "player choose" light 51 is illuminated. This alerts the player that he must select one of the bin doors 65 to be opened. What the player wins is determined by the amount of the coins collected on top of one of the bin doors 65 in the coin collecting area 63.

The selection of the bin door 65 is made by the player by pressing one of the bin select buttons 73 on the front of the cabinet 12. The pressing of bin select button causes the bin door cam 93 to be actuated by the bin door motor 92 which pivots the bin door 65 into an opened position. Any coins lying on the top of the bin door 65 that is opened will fall into win dump chute 68 and into the payout hopper 69.

The payout hopper 69 will dispense the player's share of the won coins into the payout tray 82 where they can be retrieved by the player. The coins that go to the house will be diverted through the diverter door 71 to the drop area 14 and into a bucket. The payout hopper 69 is preprogrammed by the electronic control box 83 to designate a predetermined percentage of coins between the player and the house.

If the falling coin 80 passes through a capture gate 56 that is not active to be in a winning condition, the play is a losing play. Losing plays will result in none of the bin doors 65 opening so that coins 80 will pile up in the coin collecting area 63 above the bin doors 65.

As the coins pile up, some coins will slide or roll into the overflow area 67. Each bin door 65 is provided with an adjustable overflow control ledge 66 (of variable length) to control the number of coins 80 that spill into the overflow area 67. The coins 80 that fall into the overflow area 67 are conveyed by the win dump chute 68 into the payout hopper 69. An overflow sensor 95 located in the win dump chute 68 detects the presence of coins 80 that came from the overflow area 67. The overflow sensor 95 activates the payout hopper 69 to dispense these overflow coins. Depending on how the electronic controls are programmed, the player may receive all of the overflow coins or the house may share in this payout.

Because of the transparent window 45 in the door 30 covering the game area 20, a player can watch the falling of the coin 80 through the playing field 50 and see which capture gate 56 the coin 80 passes through. The player can also see the blinking lights so that the player is aware of whether a winning combination of lights is achieved. If the player wins, he can see the bin door 65 that he selected open and watch the coins fall through the bin door and eventually be dispensed into the payout tray 82. In fact, even prior to playing the game, the player can observe and attempt to determine which bin door 65 has a larger collection of coins overlying it and the player can select that bin door to be the one that is opened if a winning play occurs.

The tilt light 53 is activated whenever a player attempts to jostle the gaming apparatus in an attempt to induce extra coins to fall into the overflow area 67 or through the bin door 65 when it is open. Any conventional tilt detection mechanism, such as a motion detector 98 can be employed such as the type used in a typical pinball game apparatus. If the tilt detection mechanism is activated, the apparatus is automatically shut down and the game is voided.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A game apparatus comprising:

a) a game area including a generally vertically disposed back plate and a generally horizontally disposed coin collecting area located adjacent a lower portion of the back plate, b) a coin entry located adjacent an upper portion of the back plate, c) a plurality of capture gates located adjacent to the back plate and above the coin collecting area, d) the coin collecting area including at least one bin door e) means for indicating when a coin falls through a particular capture gate, f) a control means linking the indicating means with the bin door for activating the opening of the bin door when the coin falls through the capture gate, causing the coin in the coin collecting area to be dispensed.

2. The game apparatus of claim 1 wherein the back plate includes a plurality of deflection pins.

3. The game apparatus of claim 1 wherein the deflection pins are mounted for reciprocating movement.

4. The game apparatus of claim 1 wherein each capture gate includes at least one indicator select light indicating that the capture gate is active for a winning play when the indicator light is illuminated.

5. The game apparatus of claim 4 wherein each capture gate has at least one upper scoring light and at least one lower scoring so that the capture gate is active for a winning play when both the upper scoring light and the lower scoring light are illuminated.

6. The game apparatus of claim 5 wherein the upper scoring light is a pair of lights disposed on opposite sides of the capture gate and the lower scoring light is a pair of lights disposed on opposite sides of the capture gate.

7. The game apparatus of claim 1 wherein the coin collecting area further includes an overflow area positioned adjacent the coin collecting area.

8. The game apparatus of claim 1 wherein the bin door is connected to a bin door cam and a bin door cam motor to effect the opening of the bin door.

9. The game apparatus of claim 1 wherein the coin collecting area includes a plurality of bin doors, each of which are independently openable.

10. The game apparatus of claim 9 wherein each bin door is connected to a bin door cam and a bin door cam motor to effect the opening of the bin door.

11. The game apparatus of claim 9 wherein the coin collecting area includes a plurality of bin dividers, each bin divider separating a bin door from an adjacent bin door.

12. The game apparatus of claim 1 further including at least one bin selection button allowing a player to select a bin door for opening when a winning play occurs.

13. The game apparatus of claim 1 further including a coin head for inserting coins into the game apparatus and a coin lift mechanism mounted between the coin head and the coin entry whereby coins inserted into the coin head are delivered to the coin entry for introduction into the playing field.

14. The game apparatus of claim 13 wherein the coin lift mechanism comprises a hopper and a coin lift track attached to the hopper and to the coin entry.

15. The game apparatus of claim 1 further including a payout hopper into which coins that fall through the bin door are collected and from which the coins can be dispensed.

16. A game apparatus comprising:

a) a game area including a generally vertically disposed back plate and a generally horizontally disposed coin collecting area located at the bottom of the back plate, b) a coin entry located at the top of the back plate, c) the back plate including a plurality of deflection pins, d) a plurality of capture gates located at approximately the center of the back plate, each capture gate being defined by a pair of adjacent enclosures, e) a trip lever positioned in the capture gate between the adjacent enclosures, f) each enclosure having at least an upper scoring light and lower scoring light, g) the coin collecting area including a plurality of bin doors, and f) the coin collecting area further including an overflow area positioned adjacent the bin doors whereby when a coin falls through a capture gate which has both the upper scoring light and the lower scoring light illuminated, a bin door is opened which causes coins in the coin collecting area to fall through the bin door and be dispensed.

17. The game apparatus of claim 16 wherein the deflection pins are mounted for reciprocating movement.

18. The game apparatus of claim 16 wherein each capture gate further includes at least one indicator select light indicating that the capture gate is active for a winning play when the indicator light is illuminated.

19. The game apparatus of claim 16 wherein the upper scoring light is a pair of lights disposed on opposite sides of the capture gate and the lower scoring light is a pair of lights disposed on opposite sides of the capture gate.

20. The game apparatus of claim 16 wherein each bin door is connected to a bin door cam and a bin door cam motor to effect the opening of the bin door.

21. The game apparatus of claim 16 wherein the coin collecting area includes a plurality of bin dividers, each bin divider separating a bin door from an adjacent bin door.

22. The game apparatus of claim 16 further including at least one bin selection button allowing a player to select a bin door for opening when a winning play occurs.

23. The game apparatus of claim 16 further including a coin head for inserting coins into the game apparatus and a coin lift mechanism mounted between the coin head and the coin entry whereby coins inserted into the coin head are delivered to the coin entry for introduction into the playing field.

24. The game apparatus of claim 23 wherein the coin lift mechanism comprises a hopper and a coin lift track attached to the hopper and to the coin entry.

25. The game apparatus of claim 16 further including a payout hopper into which coins that fall through the bin door are collected and from which the coins can be dispensed.

26. A method of playing a game:

a) providing a game area comprising a generally vertically disposed back plate and a generally horizontally disposed coin collecting area located adjacent a lower portion of the back plate, a coin entry located adjacent an upper portion of the back plate, a plurality of capture gates located adjacent to the back plate and above the coin collecting area, the coin collecting area including at least one bin door, b) introducing a coin into the playing field, c) allowing the coin to fall by gravity through one of the capture gates, d) determining whether the capture gate through which the coin falls is active for producing a winning event, e) opening a bin door in the coin collecting area if the capture gate through which the coin falls is active to produce a winning event, and f) providing to the player coins that fall through the bin door when it is opened.

27. The method of playing the game of claim 26 wherein at least one indicator light adjacent each capture gate is illuminated to indicate that a particular capture gate is active to produce a winning event.

28. The method of playing the game of claim 26 wherein the capture gate comprises at least one upper scoring light and at least one lower scoring light, and both the upper scoring light and the lower scoring light must be illuminated simultaneously in order for the capture gate to be active to produce a winning event.

29. The method of playing the game of claim 26 wherein a plurality of bin doors are provided, each of which are independently openable.

30. The method of playing the game of claim 29 wherein the player selects which of the bin doors is to be opened in the event a winning play is achieved.

31. The method of playing the game of claim 26 wherein the player receives a percentage of the coins that fall through the bin door and a house receives the remainder of the coins that fall through the bin door.

32. A method of playing a game:

a) providing a game area comprising a generally vertically disposed back plate having a plurality of deflection pins mounted thereon, a plurality of capture gates located at adjacent to the back plate, each capture gate being defined by a pair of adjacent enclosures having at least a pair of scoring lights and a trip lever positioned between the adjacent enclosures, and a generally horizontally disposed coin collecting area located adjacent the bottom of the back plate, the coin collecting area including a plurality of bin doors, and a coin overflow area positioned adjacent the bin doors, b) introducing a coin into the playing field, c) allowing the coin to fall by gravity through the deflection pins and through a capture gate whereby the trip lever is activated, d) determining whether an indicator light has been illuminated by the activation of the trip lever, e) opening one of the bin doors in the coin collecting area if the indicator light had been illuminated by the activation of the trip lever, f) providing to the player coins that fall through the bin door when it is opened.

33. The method of playing the game of claim 32 wherein at least one indicator light adjacent each capture gate is illuminated to indicate that a particular capture gate is active to produce a winning event.

34. The method of playing the game of claim 32 wherein the capture gate comprises at least one upper scoring light and at least one lower scoring light, and both the upper scoring light and the lower scoring light must be illuminated simultaneously in order for the capture gate to be active to produce a winning event.

35. The method of playing the game of claim 32 wherein the player selects which of the bin doors is to be opened in the event a winning play is achieved.

36. The method of playing the game of claim 32 wherein the player receives a percentage of the coins that fall through the bin door and a house receives the remainder of the coins that fall through the bin door.

* * * * *